United States Patent [19]

Nakatuka

[11] Patent Number: 4,937,542

[45] Date of Patent: Jun. 26, 1990

[54] DIELECTRIC FILTER

[75] Inventor: Kenji Nakatuka, Soma, Japan

[73] Assignee: Alps Electric Co., Ltd., Tokyo, Japan

[21] Appl. No.: 390,566

[22] Filed: Aug. 7, 1989

[30] Foreign Application Priority Data

Nov. 16, 1988 [JP] Japan ..... 63-149394[U]

[51] Int. Cl.[5] ..... H01P 1/20; H01P 1/205

[52] U.S. Cl. ..... 333/202; 333/204; 333/206; 333/222

[58] Field of Search ..... 233/202, 204, 205, 206, 233/207, 222, 223, 219, 219.1, 203

[56] References Cited

U.S. PATENT DOCUMENTS 4,506,241 3/1985 Makimoto et al. ..... 333/206 X
4,673,902 6/1987 333 ..... 202/
4,737,746 4/1988 Veno ..... 333/202

FOREIGN PATENT DOCUMENTS 0161806 7/1986 Japan ..... 333/204
0038601 2/1987 Japan ..... 333/204

*Primary Examiner*—Eugene R. LaRoche
*Assistant Examiner*—Seung Ham
*Attorney, Agent, or Firm*—Guy W. Shoup

[57] ABSTRACT

An ingeniously designed new dielectric filter is disclosed. Such a dielectric filter comprises a first pair of groove side wall electrodes arranged on a side wall of a groove in juxtaposition with a pair of patterned input-/output electrodes formed on a substrate. Since such an arrangement can provide a relatively high input/output coupled capacity of a dielectric filter, such a dielectric filter can be realized without requiring preparation of complex and finely patterned electrodes and formation of patterned capacitor electrodes on a face of a dielectric block that constitutes a principal component of the dielectric filter. The frequency of such a dielectric filter can be adjusted by simply abrasing that face of the dielectric block.

2 Claims, 4 Drawing Sheets

DIELECTRIC FILTER

BACKGROUND OF THE INVENTION

1. Field of the Invention

This invention relates to a dielectric filter to be suitably used for a duplexer of a wireless telecommunication apparatus such as a car telephone.

2. Prior Art

An existing dielectric filter of this type typically has a configuration as illustrated in FIG. 14 of the accompanying drawings. A pair of through bores 23*a*, 23*b* with a circular cross section are formed running from a face 21*a* to the opposite face of a rectangularly parallelepipedic block 21 of a dielectric material, whose faces except the face 21*a* having two of the openings of the through bores 23*a*, 23*b* are covered by an external electrode 25, while a pair of internal electrodes 24*a*, 24*b* are arranged respectively on the inner peripheral surfaces of the through bores 23*a*, 23*b*. Patterned capacitor electrodes 26*a* through 26*d* are formed on said face 21*a*, of which a pair of patterned capacitor electrodes 26*a*, 26*b* are respectively connected with the inner electrodes 24*a*, while the other pair of patterned capacitor electrodes 26*c*, 26*d* form input and output terminals.

Reference numeral 10 denotes a substrate to which a dielectric filter as described above is fitted. Such a substrate 10 comprises a patterned grounding electrode 11 to be connected with the outer electrode 25 and patterned input and output electrodes 12*a*, 12*b* to be respectively connected with the patterned capacitor electrodes 26*c*, 26*d*.

PROBLEMS TO BE SOLVED BY THE INVENTION

A dielectric filter as described above is so designed that a desired input/output coupled capacity is obtained by juxtaposing a number of patterned capacitor electrodes 26*a* through 26*d* on the face 21*a* of the block where two openings of the through bores 23*a*, 23*b* are found. The process of manufacturing a dielectric filter of a large capacity having such a configuration inevitably becomes a very complicated one. More specifically, in order to obtain a large capacity with such an arrangement, the space between the patterned capacitor electrodes 26*a* and 26*b* as well as the space between the electrodes 26*c* and 26*d* have to be very small and the electrodes need to have complex profiles which are rather oblong in the direction parallel to the axes of juxtaposition. Production of such complex patterned electrodes requires a very intricate process. Moreover, since all the patterned capacitor electrodes 26*a* through 26*d* are formed on a face 21*a* of the dielectric block 21, alteration of its frequency through reduction of the length of the dielectric block 21 by polishing the face 21*a* is practically impossible.

Therefore it is an object of the present invention to provide a dielectric filter having a sufficient input/output coupled capacity which is easily processed and/or adjusted in the course of manufacture and also easily fitted to a substrate at a relatively low cost.

SUMMARY OF THE INVENTION

According to the invention, the above and other objects of the invention are achieved by providing a dielectric filter having a groove formed on a face of a dielectric block, a plurality of through bores running from the bottom of said groove to the opposite face of said dielectric block, an external electrode formed on the whole surface of said dielectric block except said face, internal electrodes arranged on the inner peripheral surface of said through bores, a first and a second pairs of groove side wall electrodes arranged respectively on one and the other side walls of the groove in areas extended from the inner peripheries of the through bores and groove bottom electrodes respectively connected with said first and second pairs of groove side wall electrodes, wherein said external electrode is not formed on areas of the surface of said dielectric block located in juxtaposition with said first pair of groove side wall electrodes with a portion of said dielectric block located therebetween and connecting sections are formed such that they respectively come into contact with a pair of patterned input/output electrodes formed on a substrate to which the dielectric block is fitted.

EFFECTS

A dielectric filter having a configuration as described above comprises a first pair of groove side wall electrodes arranged on a side wall of a groove in in juxtaposition with a pair of patterned input/output electrodes formed on a substrate. Since such an arrangement can provide a relatively high input/output coupled capacity of a dielectric filter, such a dielectric filter can be realized without requiring preparation of complex and finely patterned electrodes and formation of patterned capacitor electrodes on a face of a dielectric block that constitutes a principal component of the dielectric filter. The frequency of such a dielectric filter can be adjusted by simply abrasing that face of the dielectric block.

Now the present invention will be described in greater detail by referring to the accompanying drawings which illustrate preferred embodiments of the invention.

DETAILED DESCRIPTION OF THE INVENTION

Figure 1:
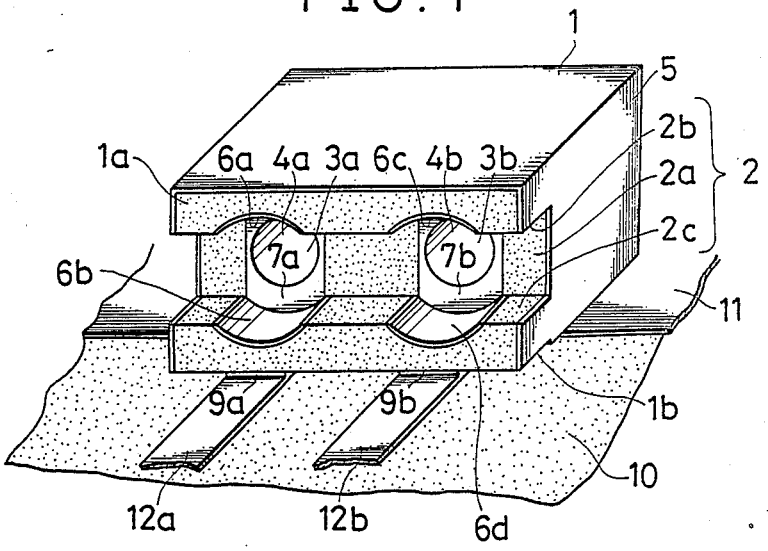
FIG. 1 is a perspective view illustrating the configuration of of an embodiment of the invention.
Figure 2:
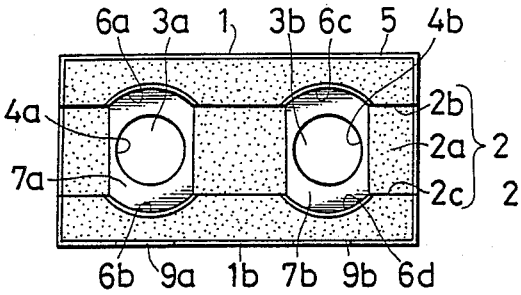
FIG. 2 is a front view of the embodiment of FIG. 1.
Figure 3:
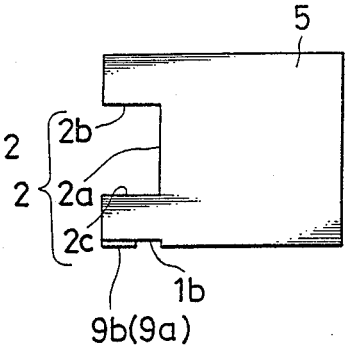
FIG. 3 is a side view of the embodiment of FIG. 1.
Figure 4:
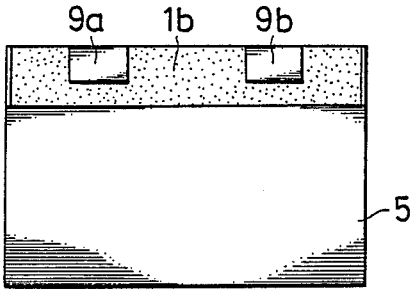
FIG. 4 is a bottom view of the embodiment of FIG. 1.
Figure 5:
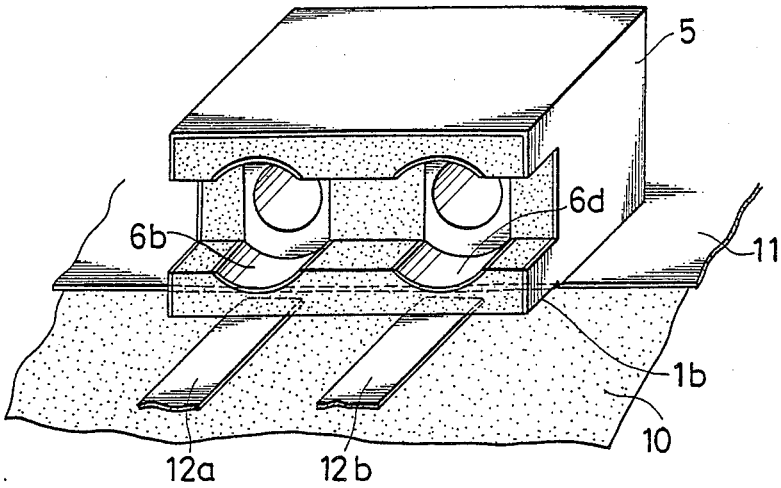
FIGS. 5 through 8 respectively show a perspective view; a front view, a side videw and a bottom view of a second embodiment of the invention.
Figure 6:
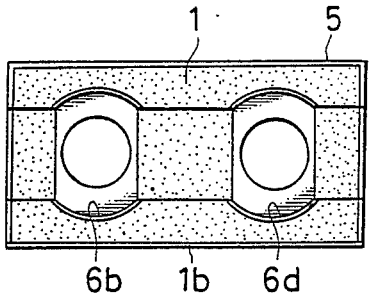
Figure 7:
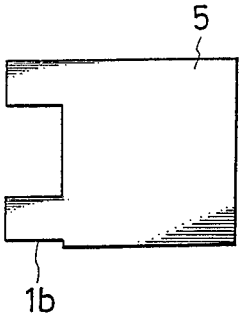
Figure 8:
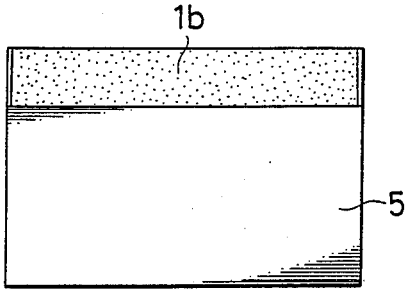

Referring to FIGS. 1 through 4 showing an embodiment of the invention, reference numeral 1 denotes a dielectric block constituting the main body of a dielectric filter. A groove 2 consisting of a groove bottom 2*a* and a pair of groove side walls 2*b*, 2*c* is formed on a face 1*a* of the dielectric block 1. A pair of through bores 3*a*, 3*b* are formed in said dielectric block 1 and run from the bottom 2*a* of said groove 2 on said face 1*a* to the opposite face. A pair of internal electrodes 4*a*, 4*b* are respectively formed on the inner periphery of said through bores 3a, 3b. The whole outer surface except the face 1a is covered by an external electrode 5, while arc-shaped side wall electrodes 6a through 6d are formed on the side walls 2b, 2c in areas extended from the inner peripheries of the through bores 3a, 3b and internal groove bottom electrodes 7a, 7b are formed to connect respectively said inner electrodes 4a, 4b and said pairs of groove side wall electrodes 6a through 6d. It should be noted that the groove side wall electrodes 6a through 6d are realized in an arc-shaped form and located on the extension of the peripheries of the through bores 3a, 3b. A portion of the conductive material 5 on the bottom face or the face that comes to be connected with a substrate 10 of said dielectric block 1 is removed to form a nonelectrode section 1b on the surface of the dielectric block 1, on which input/output terminal electrodes 9a, 9b are formed respectively in juxtaposition with the groove side wall electrodes 6b, 6d with a portion of the dielectric block 1 located therebetween.

A dielectric filter having a configuration as described above is fitted onto a substrate 10 and the external electrode 5 and the input/output terminal electrodes 9a, 9b of the filter are respectively connected with a patterned grounding electrodes 11 and patterned input/output electrodes 12a, 12b.

Figure 13:
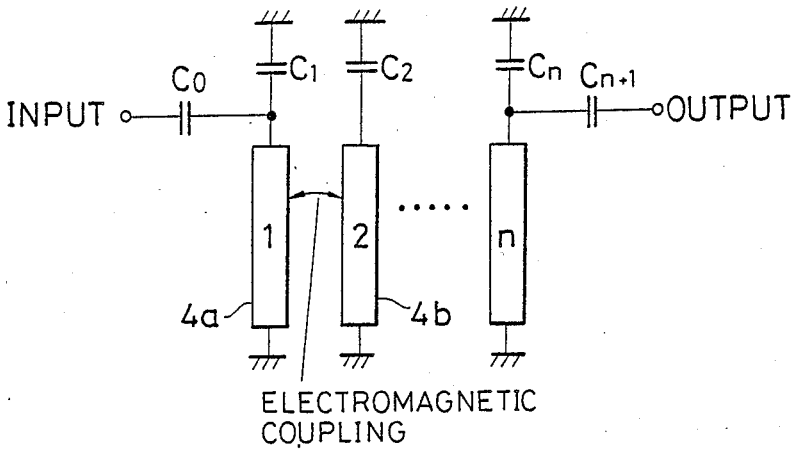
FIG. 13 is an equivalent circuit diagram of the above embodiments.
Figure 14:
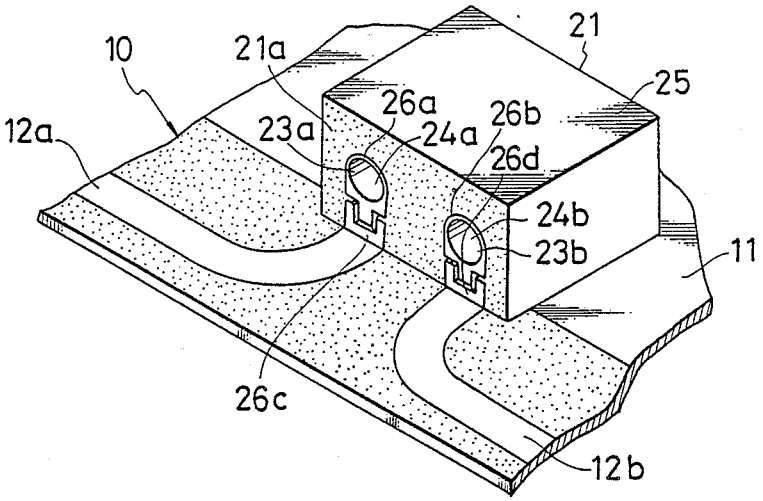
FIG. 14 is a perspective view of a conventional dielectric filter.

A dielectric filter as described above can be expressed by an equivalent circuit as shown in FIG. 13 having a number of steps n=2. More specifically, such an arrangement is good for a dielectric filter when ① the external electrodes functions as a grounding electrode, ② the internal electrodes 4a, 4b function as coupled distributed constant lines whose electromagnetic fields are mutually coupled, ③ the spaces between the groove side wall electrodes 6a, 6c and the external electrode 5 provide grounding capacities $C_1$, $C_2$ and ④ the spaces between the input/output terminal electrodes 9a, 9b and the groove side wall electrodes 6b, 6d provide input/output coupled capacities $C_0$, $C_3$.

The capacities $C_0$ through $C_3$ can be a little greater than 10 pF in the above embodiment when a dielectric material with a relative permittivity of approximately 90 is used for the dielectric block 1. Moreover, since the distances between the internal electrodes 4a, 4b and the respective groove side wall electrode pairs 6a through 6d are rather small, the dielectric filter can be free from any significant loss of capacity.

Figure 9:
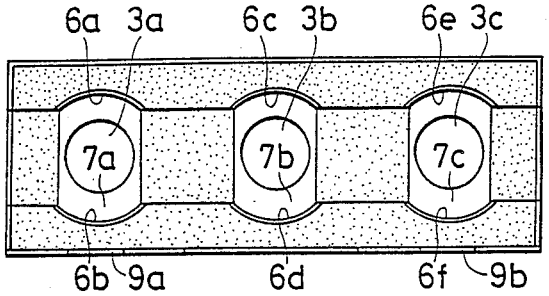
FIGS. 9 through 12 show front and bottom views of variations of the above embodiments.
Figure 10:
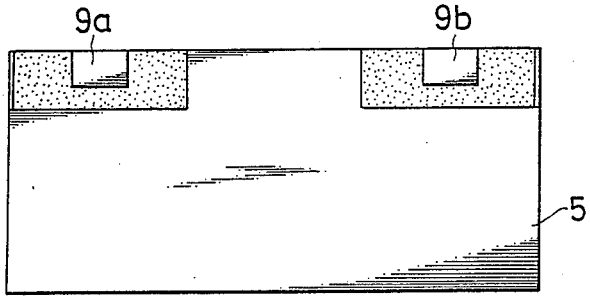
Figure 11:
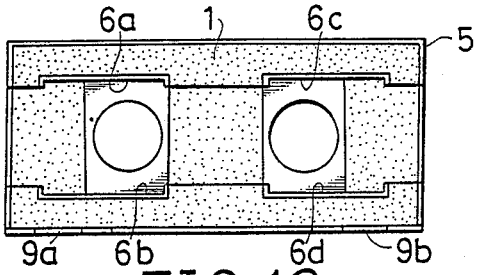
Figure 12:
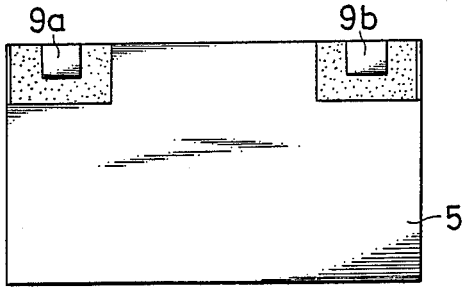

FIGS. 5 through 8 illustrate a second embodiment of the invention which is different from the first embodiment in that the input/output electrodes 9a, 9b formed on the nonelectrode section 1b on the bottom face of the dielectric block 1 are removed and consequently the patterned input/output electrodes 12a, 12b formed on the substrate 10 are juxtaposed to the groove side wall electrodes 6b, 6d with a portion of the dielectric block 1 located therebetween for capacity coupling. FIGS. 9 and 10 show a third embodiment that comprises three through bores 3a through 3c and accordingly three pairs of groove side wall electrodes 6a through 6f as well as three groove bottom electrodes 7a through 7c. Such an embodiment may be expressed by an equivalent circuit as shown in FIG. 13 having a number of steps n=3. FIGS. 11 and 12 illustrate a fourth embodiment comprising flat groove side wall electrodes 6a through 6d in place of arc-shaped electrodes.

EFFECTS OF THE INVENTION

As is apparent from the above description, a dielectric filter according to the invention comprises connecting sections in areas of the bottom face of a dielectric block that are respectively put to contact with patterned external input/output electrodes on a substrate and located in juxtaposition with a pair of first groove side wall electrodes such that consequently said first pair of groove side wall electrodes are juxtaposed to said external input/output electrodes with a portion of the dielectric block located therebetween, which provides a certain amount of input/output coupled capacity to enhance the overall input/output coupled capacity to a sufficiently high level. At the same time, since a face of the parallelepipedic dielectric block can be left free from the necessity of forming patterned capacity electrodes, the face may be freely abrased to modify the frequency of the filter. Consequently, such a dielectric filter can be produced without requiring a complicated manufacturing process and the whole area of a face of a dielectric block can be rigidly fitted to a substrate, leading to a significant reduction of manufacturing cost.

What is claimed is:

1. A dielectric filter having a groove formed on a face of a dielectric block, a plurality of through bores running from the bottom of said groove to the opposite face of said dielectric block, an external electrode formed on the whole surface of said dielectric block except said face, internal electrodes arranged on the inner peripheral surface of said through bores, a first and a second pairs of groove side wall electrodes arranged respectively on one and the other side walls of the groove in areas extended from the inner peripheries of the through bores and groove bottom electrodes respectively connected with said first and second pairs of groove side wall electrodes, wherein said external electrode is not formed on areas of the surface of said dielectric block located in juxtapostion with said first pair of groove side wall electrodes with a portion of said dielectric block located therebetween and connecting sections are formed such that they respectively come into contact with a pair of patterned input/output electrodes formed on a substrate to which the dielectric block is fitted.

2. A dielectric filter according to claim 1, wherein a pair of input/output terminal electrodes are provided in areas of said connecting sections which are in juxtaposition with said first pair of groove side wall electrodes.

* * * * *

UNITED STATES PATENT AND TRADEMARK OFFICE

CERTIFICATE OF CORRECTION

PATENT NO. : 4,937,542

DATED : June 26, 1990

INVENTOR(S) : Kenji Nakatuka

It is certified that error appears in the above-identified patent and that said Letters Patent is hereby corrected as shown below:

On the title page:

Second reference should read:

--4,673,902 6/1987 Takeda 333/202--

Signed and Sealed this

Eighteenth Day of June, 1991

*Attest:*

*Attesting Officer*

HARRY F. MANBECK, JR.

*Commissioner of Patents and Trademarks*